US012709954B2

(12) United States Patent
Zakharia et al.

(10) Patent No.: US 12,709,954 B2
(45) **Date of Patent: *Aug. 18, 2026**

(54) DOWNHOLE SETTING TOOL WITH EXHAUST DIFFUSER

(71) Applicant: G&H Diversified Manufacturing LP, Houston, TX (US)

(72) Inventors: Steven Zakharia, Houston, TX (US); Ryan Ward, Tomball, TX (US); Benjamin Vascal Knight, Katy, TX (US); Joe Noel Wells, Lindale, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/301,752

(22) Filed: Aug. 15, 2025

(65) Prior Publication Data

US 2025/0376903 A1 Dec. 11, 2025

Related U.S. Application Data

(60) Continuation of application No. 18/404,314, filed on Jan. 4, 2024, now Pat. No. 12,410,668, which is a division of application No. 17/837,880, filed on Jun. 10, 2022, now Pat. No. 11,905,776.

(60) Provisional application No. 63/209,195, filed on Jun. 10, 2021.

(51) Int. Cl.
*E21B 23/06* (2006.01)

(52) U.S. Cl.
CPC ..... *E21B 23/065* (2013.01)

(58) Field of Classification Search
CPC ..... E21B 23/0414; E21B 23/065; E21B 23/04
See application file for complete search history.

(56) References Cited

U.S. PATENT DOCUMENTS 2,815,816 A * 12/1957 Baker ..... E21B 23/065 166/123
3,029,873 A * 4/1962 Hanes ..... E21B 23/065 166/212
3,094,166 A * 6/1963 Mccullough ..... E21B 23/065 166/123
3,138,207 A * 6/1964 Peppers ..... E21B 23/065 166/212
3,220,480 A * 11/1965 Myers ..... E21B 23/065 166/120
3,255,822 A * 6/1966 Conrad ..... E21B 23/065 166/99

(Continued)

*Primary Examiner* — Kipp C Wallace
(74) *Attorney, Agent, or Firm* — Conley Rose, P.C.

(57) ABSTRACT

A method for redressing a setting tool for actuating a plug in a subterranean wellbore includes recovering the setting tool from the wellbore, the setting tool including a housing with a throughbore therein, a piston arranged for axial movement within the throughbore, a combustible element, and an exhaust diffuser configured to redirect a flow of combustion products generated in response to ignition of the combustible element, removing the piston from the throughbore of the housing, removing the exhaust diffuser from the housing, cleaning the piston and the housing, and reinstalling the piston into the housing of the setting tool with at least one of the exhaust diffuser and a replacement exhaust diffuser for subsequent use of the setting tool in a wellbore.

20 Claims, 13 Drawing Sheets

(56) References Cited

U.S. PATENT DOCUMENTS

| | | | | |
|---|---|---|---|---|
| 4,320,993 | A * | 3/1982 | Hunter | E21B 41/10 405/223.1 |
| 11,674,361 | B1 * | 6/2023 | Robicheaux | E21B 23/042 166/381 |
| 2011/0259607 | A1 * | 10/2011 | Carisella | E21B 23/0412 166/381 |
| 2013/0140023 | A1 * | 6/2013 | Baumann | E21B 43/1195 166/179 |
| 2015/0308236 | A1 * | 10/2015 | LaGrange | E21B 23/065 166/153 |
| 2018/0087330 | A1 * | 3/2018 | Bradley | E21B 23/06 |
| 2019/0323308 | A1 * | 10/2019 | Rosenthal | E21B 23/042 |
| 2019/0368293 | A1 * | 12/2019 | Covalt | E21B 33/128 |
| 2020/0256156 | A1 * | 8/2020 | Rosenthal | E21B 23/065 |
| 2020/0362653 | A1 * | 11/2020 | Robicheaux | E21B 23/042 |
| 2020/0362654 | A1 * | 11/2020 | Eitschberger | E21B 23/042 |
| 2021/0062599 | A1 * | 3/2021 | Coon | E21B 34/142 |
| 2022/0112781 | A1 * | 4/2022 | Rosenthal | E21B 23/0414 |
| 2022/0112782 | A1 * | 4/2022 | Rosenthal | E21B 23/065 |
| 2022/0259933 | A1 * | 8/2022 | Wai | E05B 85/045 |

* cited by examiner

DOWNHOLE SETTING TOOL WITH EXHAUST DIFFUSER

CROSS-REFERENCE TO RELATED APPLICATIONS

This application is a continuation of U.S. non-provisional patent application Ser. No. 18/404,314 filed Jan. 4, 2024, entitled "Downhole Setting Tool with Exhaust Diffuser", which is a division of U.S. non-provisional patent application Ser. No. 17/837,880 filed Jun. 10, 2022, entitled "Downhole Setting Tool with Exhaust Diffuser", now U.S. Pat. No. 11,905,776, granted Feb. 20, 2024, which claims benefit of U.S. provisional patent application No. 63/209,195 filed Jun. 10, 2021, entitled "Downhole Setting Tool with Exhaust Diffuser," all of which are hereby incorporated herein by reference in their entirety.

STATEMENT REGARDING FEDERALLY SPONSORED RESEARCH OR DEVELOPMENT

Not applicable.

BACKGROUND

During completion operations for a subterranean wellbore, it is conventional practice to perforate the wellbore with perforating guns along with any casing tubulars disposed therein along a targeted hydrocarbon bearing formation to provide a path for formation fluids (e.g., hydrocarbons) to flow into the wellbore. To enhance the productivity of each of typically a great many perforations, the wellbore is divided into a plurality of production zones along the targeted formation where the perforations associated with each zone are enlarged and expanded by hydraulic fracturing sometimes referred to as "fracking". Each production zone is isolated from the other downhole zones using a scaling device (e.g., a plug, a packer) installed within the wellbore prior to the given production zone being perforated.

Generally, both a setting tool and at least one perforating gun assembled along the same tool string are inserted into the wellbore in order to set the sealing device and then perforate the casing in a single trip downhole. The setting tool typically includes an explosive or combustible element for shifting the sealing device within the wellbore from an initial configuration in which fluid flow is permitted around the sealing device and a set configuration in which the sealing device plugs the wellbore. With the sealing device in the set configuration the setting tool separates from the set sealing device to permit the setting tool to be pulled back to the surface with the rest of the tool string.

In the process of setting the sealing device, the combustible element is typically used to power the setting tool and thereby drive the operable elements of the sealing device. The combustion process within the setting tool undesirably results in dramatic heating of the setting tool and wellbore fluids within the vicinity. Particularly, the combustion process generates high-velocity combustion products which may, if unimpeded, peel protective coatings or otherwise damage surfaces of the setting tool including surfaces relied on for sealing different internal chambers of the setting tool. Additionally, the dramatic heating of the setting tool and local wellbore fluids stimulates reactions between constituents of the combustion products and the heated wellbore fluids which may result in the undesirable deposition of hard reaction products which may tightly adhere onto surfaces of the setting tool. Typically, the mineral deposits formed on the setting tool must be cleaned off after use of the setting tool and before any subsequent use of the setting tool. Given the hardness of these mineral deposits and how tightly they adhere to the setting tool, removing of the mineral deposits can be a difficult, costly, and time-consuming process. For at least these reasons, any reformulation of the wellbore fluids, combustion materials or setting tools that might reduce the formation of such hard and challenging mineral deposits onto the setting tool would be greatly appreciated in the industry.

SUMMARY OF THE DISCLOSURE

An embodiment of a method for redressing a setting tool for actuating a plug in a subterranean wellbore comprises (a) recovering the setting tool from the wellbore, the setting tool comprising a housing with a throughbore therein, a piston arranged for axial movement within the throughbore, a combustible element, and an exhaust diffuser configured to redirect a flow of combustion products generated in response to ignition of the combustible element, (b) removing the piston from the throughbore of the housing, (c) removing the exhaust diffuser from the housing, (d) cleaning the piston and the housing, and (e) reinstalling the piston into the housing of the setting tool with at least one of the exhaust diffuser and a replacement exhaust diffuser for subsequent use of the setting tool in a wellbore. In some embodiments, (e) comprises orienting at least a portion of a baffle face of at least one of the exhaust diffuser and the replacement exhaust diffuser at an angle that is between 60° and 120° relative to a longitudinal axis of an exhaust port of the piston. In some embodiments, (c) comprises positioning at least one of the exhaust diffuser and the replacement exhaust diffuser in an annular expansion chamber formed radially between the outer surface of the piston and the inner surface of the housing. In certain embodiments, (e) comprises positioning at least one of the exhaust diffuser and the replacement exhaust diffuser in an internal firing chamber formed within the piston. In certain embodiments, (e) comprises releasably coupling at least one of the exhaust diffuser and the replacement exhaust diffuser to the piston. In some embodiments, (e) comprises releasably coupling at least one of the exhaust diffuser and the replacement exhaust diffuser to the housing. In some embodiments, (d) comprises cleaning the exhaust diffuser, and (e) comprises reinstalling the piston into the housing of the setting tool with the cleaned exhaust diffuser. In certain embodiments, (e) comprises reinstalling the piston into the housing of the setting tool with the replacement exhaust diffuser.

BRIEF DESCRIPTION OF THE DRAWINGS

For a detailed description of exemplary embodiments of the disclosure, reference will now be made to the accompanying drawings in which.

DETAILED DESCRIPTION

Figure 1:
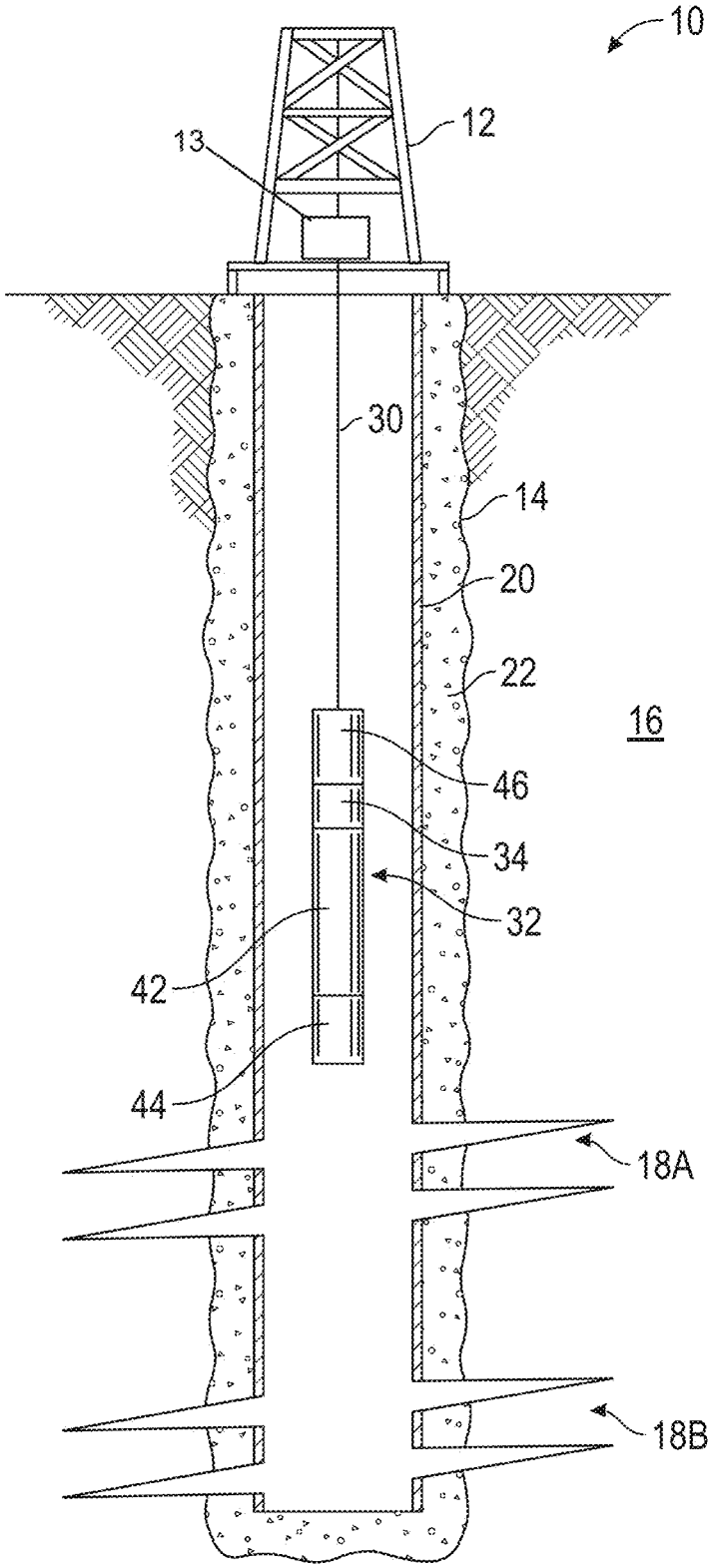
FIG. 1 is a schematic, partial cross-sectional view of a system for completing a subterranean well including an embodiment of a setting tool.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Tools used in oil well or gas wells are introduced or carried into a subterranean wellbore on a workstring, such as wire line, electric line, continuous coiled tubing, threaded workstring, or the like, for engagement at a pre-selected position within the wellbore. The wellbore can be lined with a tubular conduit such as a casing string or liner. The wellbore can be an openhole section where the drilled formation does not have the conduit supporting the drilled formation. The wellbore can include a secondary tubing member, such as production tubing, that is placed within a casing, liner, or openhole section. These completion tools include sealing devices such as expandable elastomeric plugs, permanent or retrievable plugs, packers, ball-type and other valves, injectors, perforating guns, tubing and casing hangers, cement plug dropping heads, and other devices typically encountered during the drilling, completion, or remediation of a subterranean well. Such devices and tools will hereafter collectively be referred to as "auxiliary tools." The auxiliary tool is typically set and anchored into position within the casing, tubing, or openhole section such that movements in various directions such as upwardly, downwardly, or rotationally, are resisted, and, in fact, prevented. Such movements can occur as a result of a number of causes, such as pressure differentials across the tool, temperature variances, tubing or other conduit manipulation subsequent to setting for activation of other tools in the well, and the like.

The auxiliary tool typically must be set or actuated to position the auxiliary tool at the required depth within the casing, liner, tubing, or openhole section. In some cases, the auxiliary tool may comprise, for example, a plug or packer including a packing element that will form a seal when energized. As described above, the activation or manipulation of some of such auxiliary tools often is achieved by use of a setting tool which can be introduced into the wellbore along with or subsequent to the auxiliary tool on a workstring, such as wire or electric line, continuous or coiled tubing, threaded tubing, drill pipe, or by other known means. In some applications, the setting tool includes a piston to move or stroke a portion of the setting tool relative to stationary portion of the setting tool to apply a setting force in compression or in tension to the auxiliary tool. Pressure can be applied to face of the piston within the setting tool to generate the setting force to set or actuate the auxiliary tool.

Some setting tools utilize an explosive or combustible charge or element to develop a high-pressure gas within a firing chamber of the setting tool following ignition of the combustible element. The high pressure generated by the burning or firing of the pyrotechnic charge drives a piston, stroking rod, or other member of the setting tool to move relative a stationary member to cause the manipulation of the auxiliary tool. By "burning" or "firing" it is meant the continuous generation, sometimes relatively slowly, of pressure by ignition of a power charge initiated reaction which results in a pressure increase within a firing chamber of transmittable gaseous pressure within the apparatus. The term "detonate" can also be used to describe a sudden generation of gaseous pressure. Sometimes the terms "detonate" and "ignite" are used to describe a sudden generation of gaseous pressure. The terms "detonate", "burning", "igniting," or "firing", all describe the generation of gaseous pressure by the burning of the combustible element with different timescales.

The ignition of the combustible element to burn is started with an igniter. The igniter can be comprised of a plurality of igniters. For example, the igniter can be a single primary igniter, a primary igniter and secondary igniter, or a primary, secondary, and embedded igniter. The primary igniter and/or secondary igniter can comprise a tube, an electronic ignition device, and a pyrotechnic material that creates a jet of heat and flame. In some embodiments, the igniter can be installed within a firing head or setting tool initiator and connected to the firing chamber of the setting tool. The upper end of the firing head can couple to any combination of a cable head, an instrument sub, a quick connect sub, a switch sub, or any other type of with a threaded connection and an electrical connection.

In a typical deployment of a toolstring including a conventional setting tool, one or more operators at the surface prepare the toolstring for conveyance into the wellbore. The toolstring can comprise, among other things, a workstring, the conventional setting tool, and an auxiliary tool. The operator may releasably connect the auxiliary tool to the setting tool, install a power charge into the firing chamber of the setting tool, and connect the setting tool initiator to the conventional setting tool. The operator may then direct the conveyance of the tool sting into the wellbore via the workstring and convey the toolstring to the desired location. The location of the toolstring can be verified by any combination of a measured length of the toolstring and the number of collars counted by a collar locator.

Once at the desired location, the operator may signal an initiator switch of the setting tool initiator to ignite the igniter to activate the conventional setting tool to set the auxiliary tool at the desired location. The combustible element burns in response to ignition of the igniter to produce high pressure and high temperature combustion products that can corrode, erode, or otherwise damage surfaces of the setting tool. In some instances, damage may occur from the combustion products to protective coatings formed on surfaces of the setting tool. The erosion of the protective coating can cause corrosion of sealing surfaces of the setting tool and thereby undesirably shorten the operational lifespan of the conventional setting tool. Moreover, hot combustion products may form mineral deposits upon the surfaces of the setting tool, which may be time consuming or impractical to remove, also shortening the operational life of the conventional setting tool. The elevated heat of the combustion products may cause some of them to bond to surfaces of the setting tool, leading to rapid corrosion. An operator of the toolstring may require the setting of twenty or more auxiliary tools using one or more setting tools in a given application. Damage to the setting tool from the hot and the subsequent shortening of the service life of the setting tool can prevent the operator from providing an efficient and reliable plugging and perforation of the wellbore.

Thus, it is desirable to develop a setting tool configured to minimize or prevent damage which occurs thereto following ignition of the combustible element of the setting tool.

Embodiments described herein include a setting tool comprising an exhaust diffuser positioned along a flowpath of combustion products generated by the detonation of a combustible element of the setting tool. The exhaust diffuser reduces the velocity of the combustion products flowing along the combustion product flowpath to thereby reduce the power which the combustion products contact components of the setting tool, such as seal surfaces of a housing of the setting tool. Reducing the velocity and attendant power the combustion products may project against components of the setting tool reduces the abrasive potential of the combustion products, thereby preventing or at least mitigating damage (e.g., the peeling of protective coatings) that occurs to components of the setting tool in response to contact with the combustion products. Additionally, by mitigating the power of the combustion products before they are permitted to contact at least some surfaces of the setting tool (e.g., seal surfaces of the setting tool), the issue of combustion products bonding to surfaces of the setting tool may also be eliminated or at least substantially mitigated. Further, the exhaust diffuser may act to trap debris resulting from detonation of the combustible element (e.g., material remains of the combustible element) within a combustion or firing chamber of the setting tool, preventing those debris from percolating through the setting tool, making the setting tool significantly easier to clean and redress before being reused in the same or a different wellbore.

Embodiments of setting tool exhaust diffusers described herein include one or more baffle faces and one or more passages positioned downstream from the one or more baffle faces along the combustion product flowpath. The one or more passages to direct the high-pressure and high-temperature combustion products away from protective coatings formed on the seal surfaces of the setting tool. The one or more passages of the exhaust diffuser are configured to diffuse the flow of high-pressure and high-temperature combustion products away from impinging directly onto the seal surface. The passages can be made of corrosion resistant materials and reused. The passages can also be removed and replaced as needed. The setting tool can be cleaned, inspected, and redressed on location (or elsewhere) after usage in the wellbore by service personnel. The passages of the exhaust diffuser protects the piston of the setting tool during usage to increase the life of the assembly and greatly reduce the number of setting tool that fail inspection after usage.

Figure 2A:
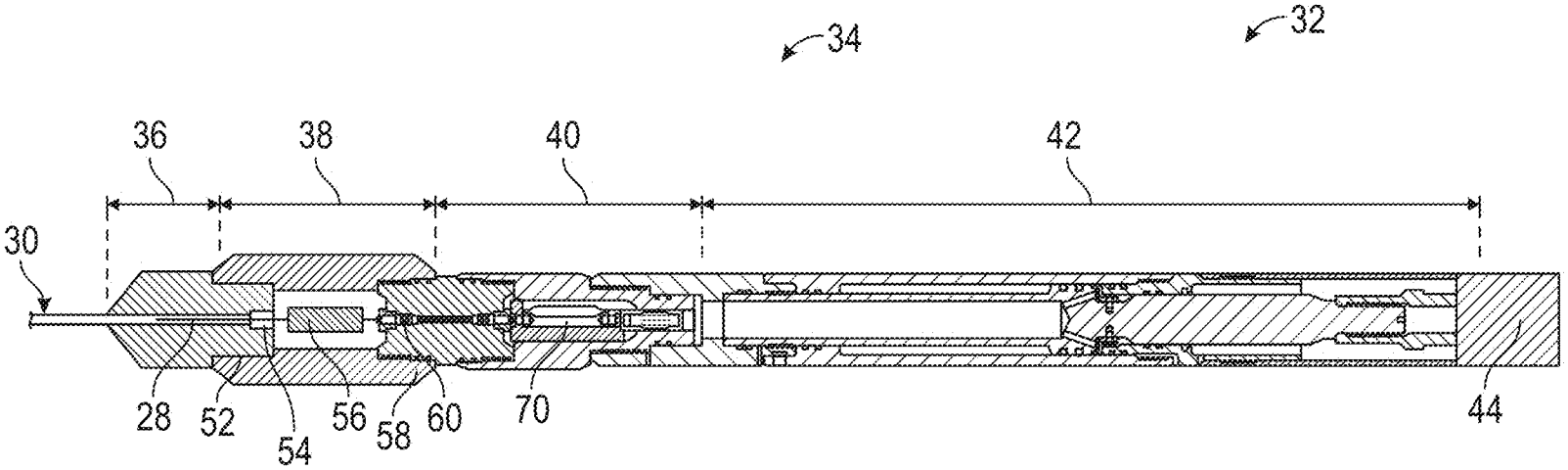
FIG. 2A is a partial cross-sectional view of a system for completing a subterranean well including an embodiment of a setting tool.
Figure 2B:
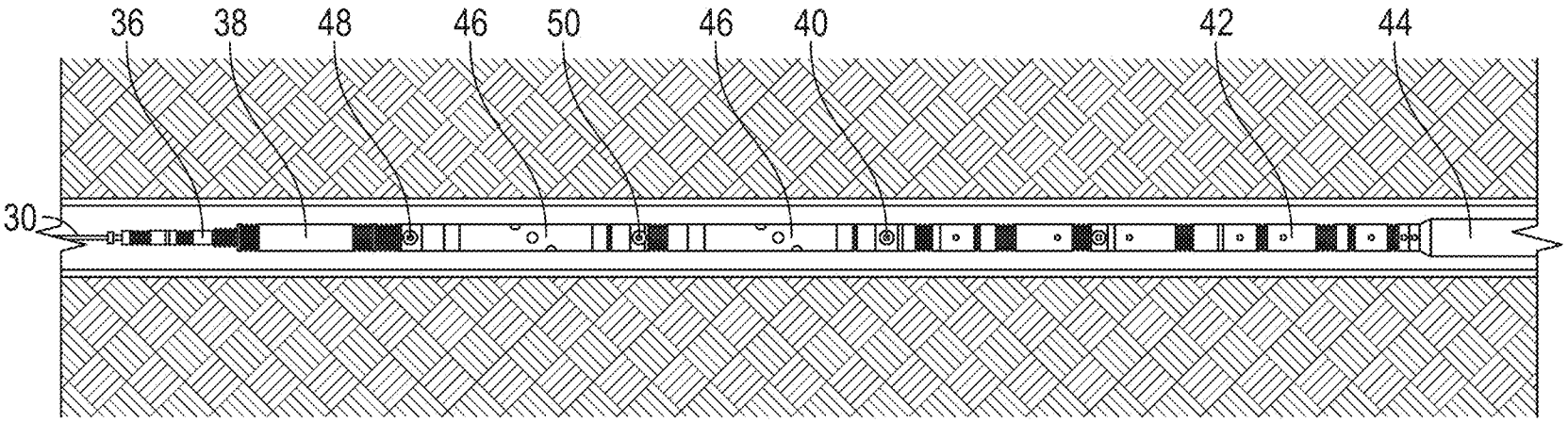
FIG. 2B is a schematic view of a system for completing a subterranean well including another embodiment of a setting tool.

Referring now to FIGS. 1 and 2, an embodiment of a system 10 for plugging a wellbore 14 extending through a subterranean earthen formation 16 is shown. In this exemplary embodiment, system 10 includes a surface assembly or servicing rig 12 that extends over and around the wellbore 14 that penetrates the earthen formation 16 for the purpose of recovering hydrocarbons from a first production zone 18A and a second production zone 18B (collectively the production zones "18"). The wellbore 14 can be drilled into the earthen formation 16 using any suitable drilling technique. While shown as extending vertically from the surface in FIG. 1, the wellbore 14 can also be deviated, horizontal, and/or curved over at least some portions of the wellbore 14. For example, the wellbore 14, or a lateral wellbore drilled off of the wellbore 14, may deviate and remain within one of the production zones 18. The wellbore 14 can be cased, open hole, contain tubing, and can generally be made up of a hole in the ground having a variety of shapes and/or geometries as is known to those of skill in the art. In the illustrated embodiment, a casing string 20 made up of multiple sections of threaded pipe joined with threaded couplings can be placed in the wellbore 14 and secured at least in part by cement 22.

The servicing rig 12 of system 10 can be one of a drilling rig, a completion rig, a workover rig, a wireline system, or other structure and supports a toolstring 32 in the wellbore 14. Servicing rig 12 includes a surface controller 13 in signal communication with one or more downhole tools of toolstring 32. In other embodiments, other surface systems or structures can also support the toolstring 32. The servicing rig 12 can also comprise a derrick with a rig floor through which the toolstring 32 extends downward from the servicing rig 12 into the wellbore 14. It is understood that other mechanical mechanisms, not shown, can control the run-in and withdrawal of the toolstring 32 in the wellbore 14.

In this exemplary embodiment, toolstring 32 generally includes a workstring 30, one or more perforating guns 46 (hidden from view in FIG. 2), a signal sub 34, a setting tool 42, and an auxiliary tool 44. It may be understood that in other embodiments the configuration of tool string 32 may vary. For example, in some embodiments, tool string 32 may additionally include a fishneck, one or more weight bars, a release tool, and/or one or more other downhole tools. The workstring 30 can be any of a string of jointed pipes, a slickline, a coiled tubing, and a wireline. Auxiliary tool 44 may comprise one or more frac plugs, one or more packers, one or more tubing hangers, one or more completion components such as screens and/or production valves, sensing and/or measuring equipment, and other equipment which are not shown in FIGS. 1 and 2. The toolstring 32 can be lowered into the wellbore 14 to position the setting tool 42 to set or actuate a frac plug at a predetermined depth.

In this exemplary embodiment, cable head 36 is the uphole-most component of toolstring 32 and includes an electrical connector for providing electrical signal and power communication between the workstring 30 and the other components (e.g., instrument sub 38, setting tool initiator 40, setting tool 42, etc.) of toolstring 32. The instrument sub 38 can contain one or more environmental sensors 56. For example, the instrument sub 38 can include a magnetic sensor (e.g., a casing collar locator (CCL)), a temperature sensor, a pressure sensor, or a motion sensor (e.g., an accelerometer). The magnetic sensor, generally referred to as a CCL, is generally configured to transmit an electrical signal to the surface via workstring 30 when the CCL passes through a casing collar, where the transmitted signal may be recorded at the surface as a collar kick to determine the position of toolstring 32 within wellbore 14 by correlating the recorded collar kick with an open hole log.

Additionally, in this exemplary embodiment, a setting tool initiator 40 is coupled to a downhole end of instrument sub 38 and is generally configured to provide a connection between the instrument sub 38 and the setting tool 42. Setting tool initiator 40 couples the cable head 36 of the toolstring 32, via the instrument sub 38, to the setting tool 42 and an auxiliary tool 44, and is generally configured to pass electronic signals and/or power from the conductor 28 within the workstring 30 to an igniter within the toolstring 32. Setting tool initiator 40 may also include mechanical and/or electrical components to fire the setting tool 42.

In this exemplary embodiment, setting tool 42 is coupled to a downhole end of setting tool initiator 40 and is generally configured to set or install auxiliary tool 44 within casing string 20 to isolate desired segments of the wellbore 14, as will be discussed further herein. Typically, the auxiliary tool 44 is intended to be set or actuated to position the auxiliary tool 44 at the required depth within the wellbore 14. The actuation or setting of the auxiliary tool 44 may displace a portion of the auxiliary tool relative to another portion to anchor or position the auxiliary tool 44 to a location within the wellbore.

In some embodiments, auxiliary tool 44 comprises a slip that engages or grips the casing string 20. In some embodiments, auxiliary tool 44 also includes a packing element, generally formed of an elastomeric material configured to seal against the casing string 20 when compressed or energized. Particularly, the packing element may form a seal against the inner surface of casing string 20 to restrict fluid communication through wellbore 14 across the auxiliary tool 44. The auxiliary tool 44 may be any suitable downhole tool or frac plug known in the art while still complying with the principles disclosed herein. Additionally, it may be understood that although setting tool 42 is shown in FIGS. 1 and 2 as incorporated in toolstring 32, setting tool 42 may be used in other toolstrings which vary in configuration from toolstring 32. Following the setting of the auxiliary tool 44, shaped explosive charges of the one or more perforating guns 46 may be detonated at a desired location in the wellbore 14.

Figure 3:
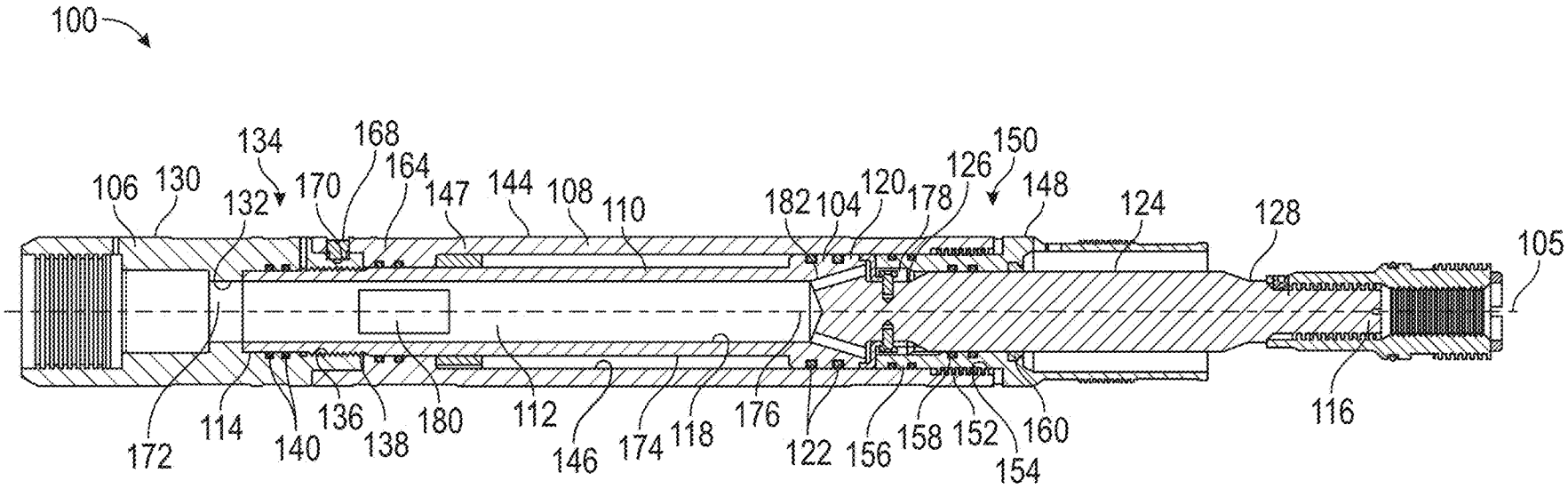
FIG. 3 is a side cross-sectional views of an embodiment of a setting tool.
Figure 4:
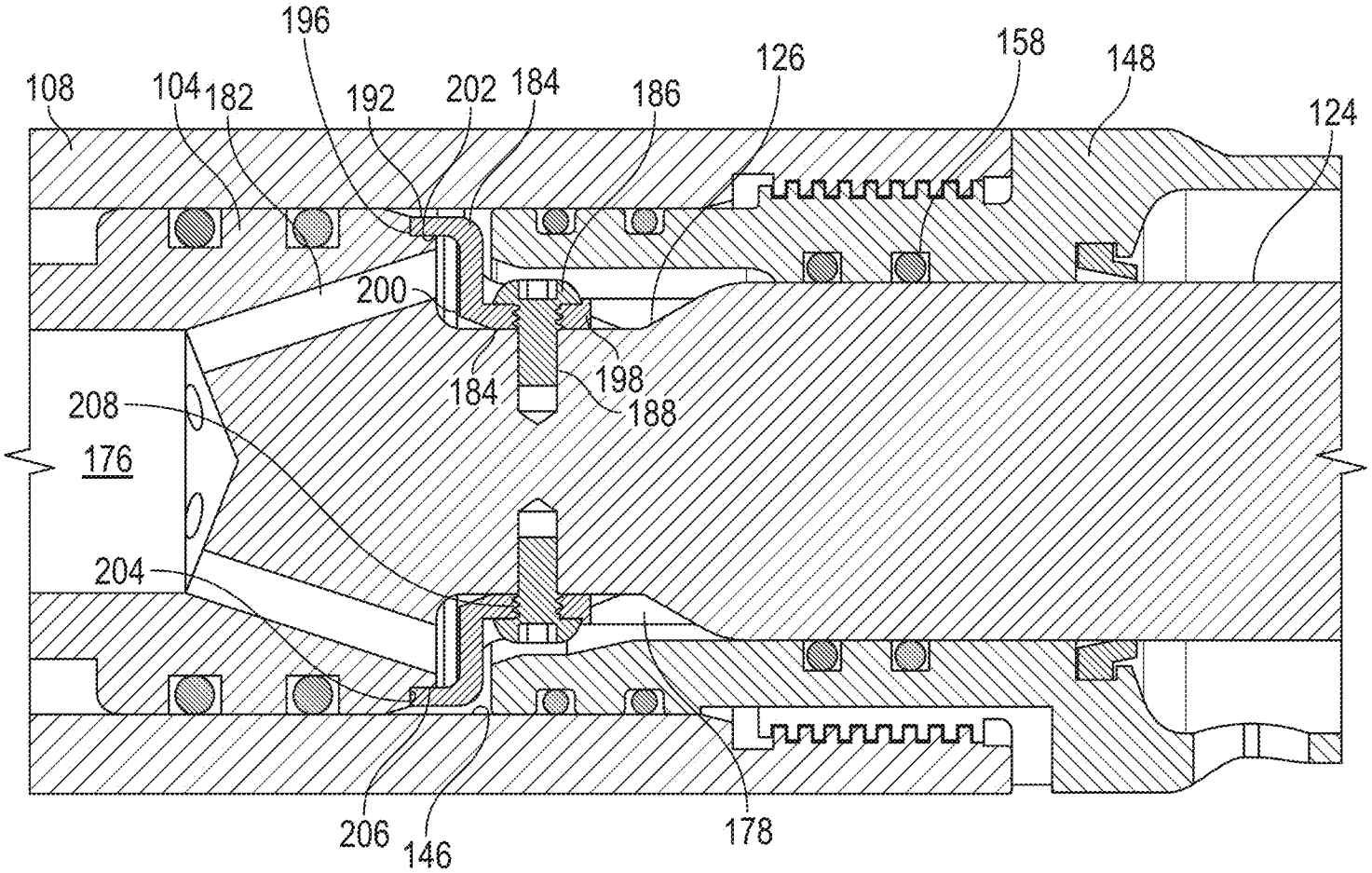
FIG. 4 is a cross-sectional view of an embodiment of an exhaust diffuser of the setting tool of FIG. 3.

Turning now to FIG. 3, an embodiment of a setting tool 100 is shown. In some embodiments, setting tool 42 shown in FIGS. 1 and 2 may be configured similarly as the setting tool 100 shown in FIG. 3. Additionally, setting tool 100 may be utilized in toolstrings which vary from the configuration of toolstring 32 shown in FIGS. 1 and 2. In this exemplary embodiment, setting tool 100 has a central or longitudinal axis 105 and generally includes an upper connector 106, a piston 104, and a housing 108 in which the piston 104 is slidably positioned. Piston 104 is generally cylindrical having an outer surface 110, an internal bore or passage 112, a first or uphole end 114, and a second or downhole end 116 opposite the uphole end 114. The internal bore 112 of piston 104 extends centrally through piston 104 and is defined by a generally cylindrical inner surface 118 which extends a portion of the length from the uphole end 114 to the downhole end 116. The piston 104 has an annular seal assembly 122 comprising a pair of annular seals disposed on an outer surface 120. The piston 104 further includes an outer surface 124 located proximal to the downhole end 116. The outer surface 124 has a first recess 126 proximate the annular seal assembly 122 and a second recess 128 proximate the downhole end 116.

The upper connector 106 of setting tool 100 has a generally cylindrical shape with an outer surface 130 and an inner surface 132. The upper connector 106 is releasably coupled to the piston 104 via a threaded connection 134. The threaded connection 134 includes an internal connector 136 of the upper connector 106, an external connector 138 of the piston 104, and annular seals 140 in scaling engagement with piston 104. In an embodiment, upper connector 106 can be combined with piston 104 to form a unitary body. Additionally, it may be understood that the configuration of upper connector 106 may vary in other embodiments.

The housing 108 of setting tool 100 is generally cylindrical and slidably disposed on the piston 104 and has an outer surface 144 and an inner surface 146 defining a throughbore of the housing 108. In this exemplary embodiment, housing 108 comprises a first or uphole section housing 147 and a second or downhole housing section 148 coupled end-to-end to the uphole section housing 147 by a threaded connection 150 to form the housing 108 whereby relative axial movement is restricted between housing sections 147 and 148. It may be understood that in other embodiments housing 108 may comprise a single, integrally or monolithically formed housing while in other embodiments housing 108 may comprise more than two separate housing sections connected end-to-end in a manner similar to the connection formed between section housings 147 and 148.

Downhole housing section 148 of housing 108 interfaces with the auxiliary tool 44 and thus may also be referred to herein as housing adapter 148. Threaded connection 150 can include an external connection 152 of the housing adapter 148, an internal connection 154 of the uphole housing section 147, and an annular seal assembly 156 in sealing engagement with the uphole housing section 147. The housing adapter 148 of housing 108 can include a seal assembly 158 and a wiper seal 160 in scaling engagement with outer surface 124 of the piston 104. Generally, housing 108 includes a seal assembly 164 in sealing engagement with the outer surface 110 of the piston 104. In some embodiments, housing 108 may be secured to the upper connector 106 by a shear screw 168 to initially restrict relative axial movement between housing 108 and piston 104. The shear screw 168 may be threadingly connected to the housing 108 and disposed into a recess 170 on the upper connector 106. The shear screw 168 can be a frangible connector that shears, e.g., breaks, at a predetermined shear stress amount. The shear screw 168 can retain the housing 108 in a position relative to the upper connector 106 until an axial force of a predetermined amount shears or breaks to the shear screw 168 as will be described further herein.

In this exemplary embodiment, housing 108 of setting tool 100 defines an internal balance chamber 174, an internal firing chamber 176, and an internal expansion chamber 178. The balance chamber 174 comprises an annular space defined by the inner surface 146 of the housing 108, the outer surface 110 of the piston 104, the seal assembly 164 of the housing 108, and the annular seal assembly 122 of the piston 104. At least a portion of the inner surface 146 comprises a seal surface against which seal assembly 122 sealingly engages. Additionally, in some embodiments, at least a portion of the inner surface 146 may be defined by a protective coating intended to protect the inner surface 146 from damage (e.g., corrosion) during the operation of setting tool 100. The balance chamber can initially contain air at atmospheric or near atmospheric pressure.

The firing chamber 176 of the setting tool 100 is located in the internal bore 112 of the piston 104. In some embodiments, the firing chamber 176 also includes at least a portion of the inner bore 172 of the upper connector 106. The firing chamber 176 can contain air at atmospheric or near atmospheric pressure and receives a combustible element 180 (shown only schematically in FIG. 3) disposed therein. Combustible element 180 may comprise a pyrotechnic or "black powder" charge that comprises a mixture of gun powder or black powder, filler material, and an oxidizer, similar to a road flare, that is slidingly fits into the firing chamber. Combustible element 180 is configured to produce high-pressure and high-temperature combustion products within the firing chamber 176 in response to being ignited by an igniter (e.g., an igniter of setting tool initiator 40). A high-pressure gas can be generated by the burning or firing of the combustible element 180. By "burning" or "firing" it is meant the continuous generation, sometimes relatively slowly, of gas pressure by ignition of a power charge which results in a pressure increase within a firing chamber of transmittable gaseous pressure within the apparatus. Sometimes the term "detonate" is used to describe a sudden generation of gaseous pressure. The terms "detonate", "burning", or "firing", all describe the generation of gaseous pressure by the burning of the power charge with different timescales.

The expansion chamber 178 of the setting tool 100 includes an annular space defined by the inner surface 118 of the housing 108, the first recess 126 of the piston 104, the annular seal assembly 122 of the piston 104, and the seal assembly 158 of the housing adapter 148. The expansion chamber 178 may initially contain air at atmospheric or near atmospheric pressure. In this exemplary embodiment, piston 104 comprises one or more internal exhaust ports 182 which extend at an incline from the firing chamber 176 to the expansion chamber 178, thereby fluidically connecting the firing chamber 176 to the expansion chamber 178. Particularly, the exhaust ports 182 of piston 104 extend at an acute angle to a central axis of the setting tool 100 from the inner surface 118 of inner bore 112 to an annular shoulder formed on the outer surface 110 of piston 104. While in this exemplary embodiment the exhaust ports 182 of piston 104 are inclined relative to a central axis of the piston 104, in other embodiments, exhaust ports 182 may extend only axially, only radially, or in one or more different directions. In embodiments in which exhaust ports 182 extend radially through piston 104, a baffle face 200 of an exhaust diffuser 184 (will be described further herein) may be oriented in the direction of the central axis of piston 104, orthogonal the radial flow of combustion products exiting the radially extending exhaust ports 182.

During operation of the setting tool 100, the combustible element 180 is ignited by an igniter. The ignition of the combustible element 180 produces high-pressure and high-temperature combustion products within the firing chamber 176. The combustion products flow through exhaust ports 182 and into expansion chamber 178 as pressure builds within the firing chamber 176 of the piston 104. The pressure within the expansion chamber 178, created by the burning of the combustible element 180, acts against an axially-projected piston area of the uphole end the housing adapter 148, defined by the inner surface 145 of the housing 108 and the outer surface 124 of the piston 104, to move the housing 108 relative to the piston 104. The combustion products exiting the exhaust ports 182 can impinge on the inner surface 146 of the housing 108 and may damage or degrade a portion of the inner surface 146, including portions of inner surface 146 defined and protected by a protective coating applied. Exposure of the uncoated inner surface 146 of the housing 108 to wellbore fluids can induce corrosion and shorten the service life of the housing 108. Additionally, combustion products may form mineral deposits on setting tool 100 including on the inner surface 146. Damage to inner surface 146 may prevent seal assembly 122 from forming a seal against one or more portions of the inner surface 146, permitting combustion products to undesirably leak across the interface formed between seal assembly 122 and inner surface 146, thereby lowering the setting force which may be generated by setting tool 100 for setting the auxiliary tool 44.

Figure 6:
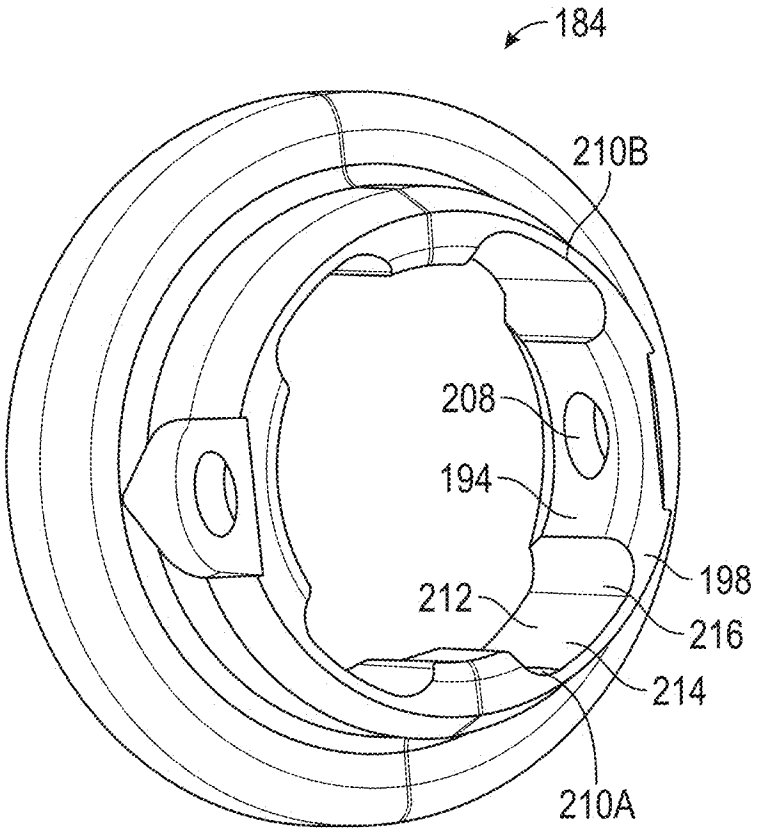
FIGS. 5-7 are side views of the exhaust diffuser of FIG. 4.
Figure 5:
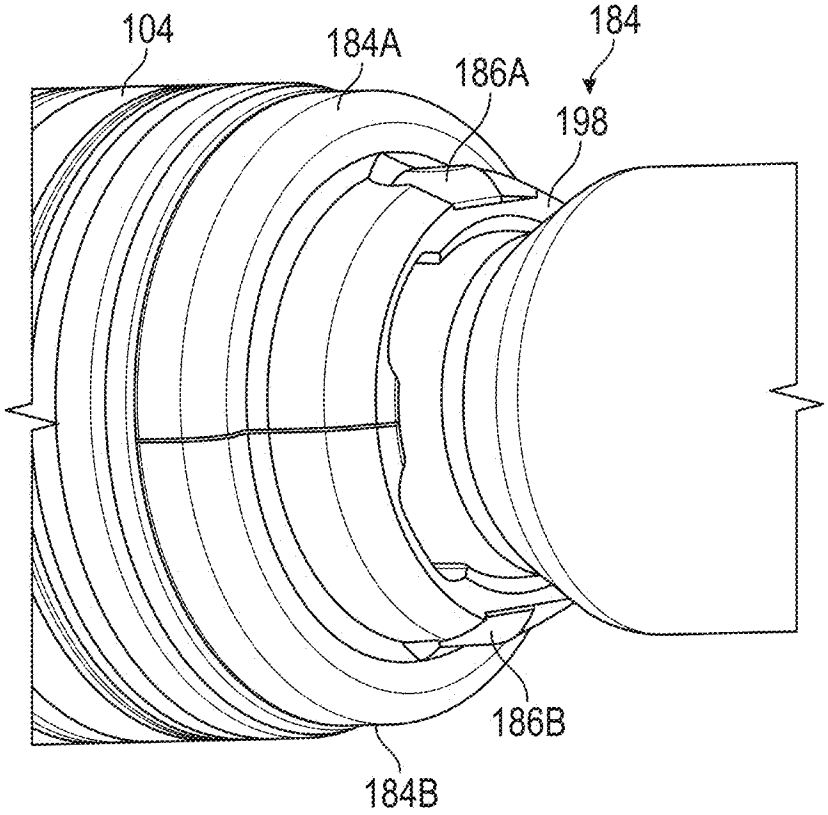
Figure 7:
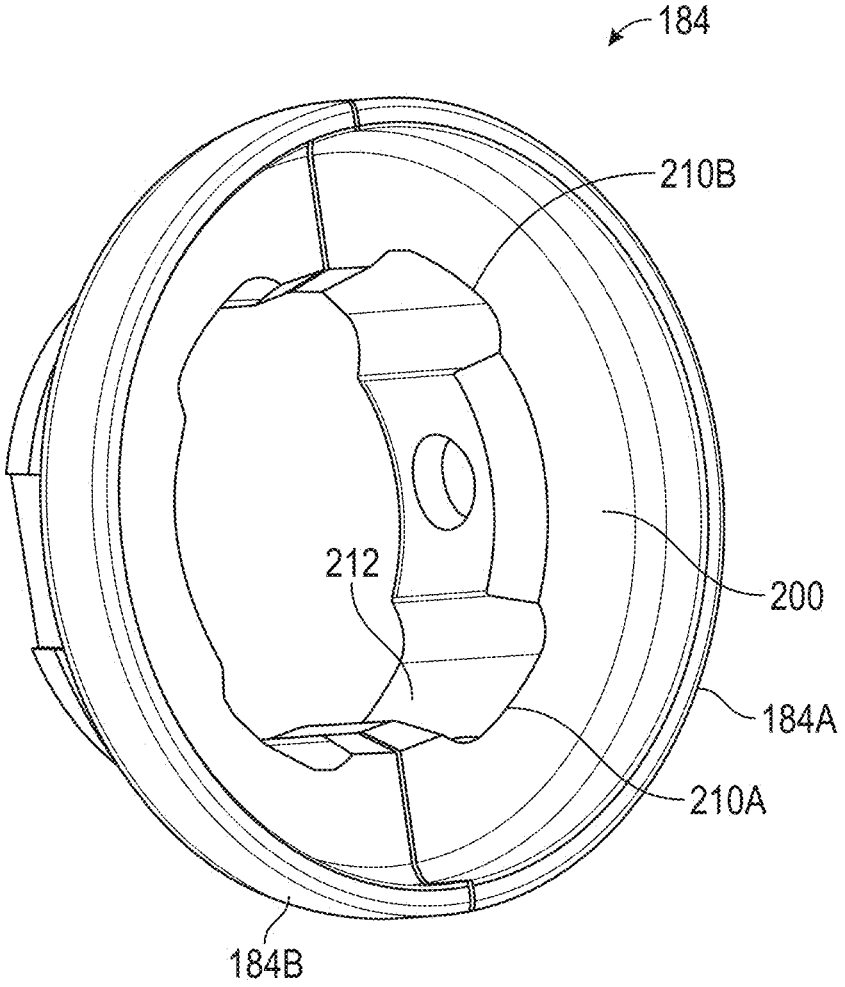

The service life of the inner surface 146 of the housing 108 can be extended and maximized by protecting surfaces of setting tool 100, including inner surface 146, from impingement with high-pressure and high-velocity combustion products exiting exhaust ports 182. Turning now to FIGS. 4-7, it may be initially understood that FIG. 5 is a cross-sectional view of a portion of setting tool 100, while FIG. 6 is the same portion of setting tool 100 with the cross-sectional view rotated about 45 degrees to intersect one of the exhaust passages 210.

In this exemplary embodiment, setting tool 100 includes an exhaust diffuser 184 is disposed in the first recess 126 and coupled to piston 104. Exhaust diffuser 184 is separate and distinct from both the piston 104 and housing 108, but may be releasably (e.g., via one or more fasteners, snap connectors) or permanently (e.g., via welding, brazing) coupled to either the piston 104 or the housing 108. For example, the exhaust diffuser 184 can be retained in the first recess 126 by one or more fasteners 186 installed into one or more fastener ports 188 in the piston in the first recess 126 of the piston 104. In this exemplary embodiment, exhaust diffuser 184 is generally cylindrical having a radially outer surface 192, a radially inner surface 194, a baffle face 200, and an uphole surface 202 which may comprise a portion of the baffle face 200. Surfaces 192 and 194 extend between longitudinally opposed uphole and downhole ends 196 and 198, respectively, of the exhaust diffuser 184. In this exemplary embodiment, the inner surface 194 of exhaust diffuser 184 is held in contact with the first recess 126 by the fastener 186 installed through an aperture 208. The uphole end 196 of exhaust diffuser 184 may abut the downhole surface 204 of the piston 104. Additionally, an uphole surface 202 (a portion of the inner surface 194 of the exhaust diffuser 184) contacts or is positioned adjacent the outer surface 206 of the piston 104.

It may be understood that exhaust diffuser 184 may comprise a single integrally or monolithically formed member or a plurality of members coupled together. For example, in this exemplary embodiment, the exhaust diffuser 184 comprises a first exhaust diffuser portion 184A and a second exhaust diffuser portion 184B coupled to the piston 104 by a first fastener 186A and a second fastener 186B. Although the exhaust diffuser 184 is shown consisting of two parts in FIGS. 4-7, it may be understood the exhaust diffuser 184 can be formed by 1 any number of parts. In this exemplary embodiment, exhaust diffuser 184 includes one or more exhaust passages 210 that extend entirely from the baffle face 200 to the downhole end 198 of the exhaust diffuser 184. In this exemplary embodiment, baffle face 200 is annular and planar. Additionally, baffle face 200 is oriented generally orthogonal to a longitudinal axis of each exhaust port 182. Particularly, in this exemplary embodiment, at least a portion of the baffle face 200 is oriented at an angle of approximately 60° to 120° to the longitudinal axis of each exhaust port 182; however, the orientation of baffle face 200 relative to exhaust ports 182 may vary in other embodiments. In this arrangement, combustion products impinging on the baffle face 200 are forced to make a substantial change in direction, thereby reducing the velocity of the combustion products in response to impinging against the baffle face 200. Additionally, exhaust diffuser 184 may trap at least some debris generated by the ignition of combustible element 180 in the firing chamber 176 such that the debris are prevented from entering expansion chamber 178, making the cleaning and redressing of setting tool 100 substantially easier.

In this exemplary embodiment, exhaust passage 210 comprises a slot that extends radially into the exhaust diffuser 184 from the inner surface 194 to a passage surface 212. In this configuration, the exhaust passage is defined by passage surface 212, a first side 214, and a second side 216 distal from the first side 214. The passage surface 212 may be curved with a radius about the longitudinal axis with the first side 214 at an angle from the second side 216. As one example, exhaust passage 210 can be formed by a 15° angle measured from the first side 214 to the second side 216. It is understood that the 15° angle is an example and the angle can be equal to zero or to a non-zero angle that varies from 15°. Additionally, the first side 214 and second side 216 of the exhaust passage 210 can be flat, curved, or any combination thereof. To provide a few examples, the first side 214 and second side 216 can be formed by a flat surface with an acute angle, co-planar, or obtuse angle measured from a plane that extends from the longitudinal axis of the exhaust diffuser 184. Additionally, it may be understood that exhaust diffuser 184 can include any number of exhaust passages 210 including a single exhaust passage 210 or zero exhaust passages 210.

Figure 8:
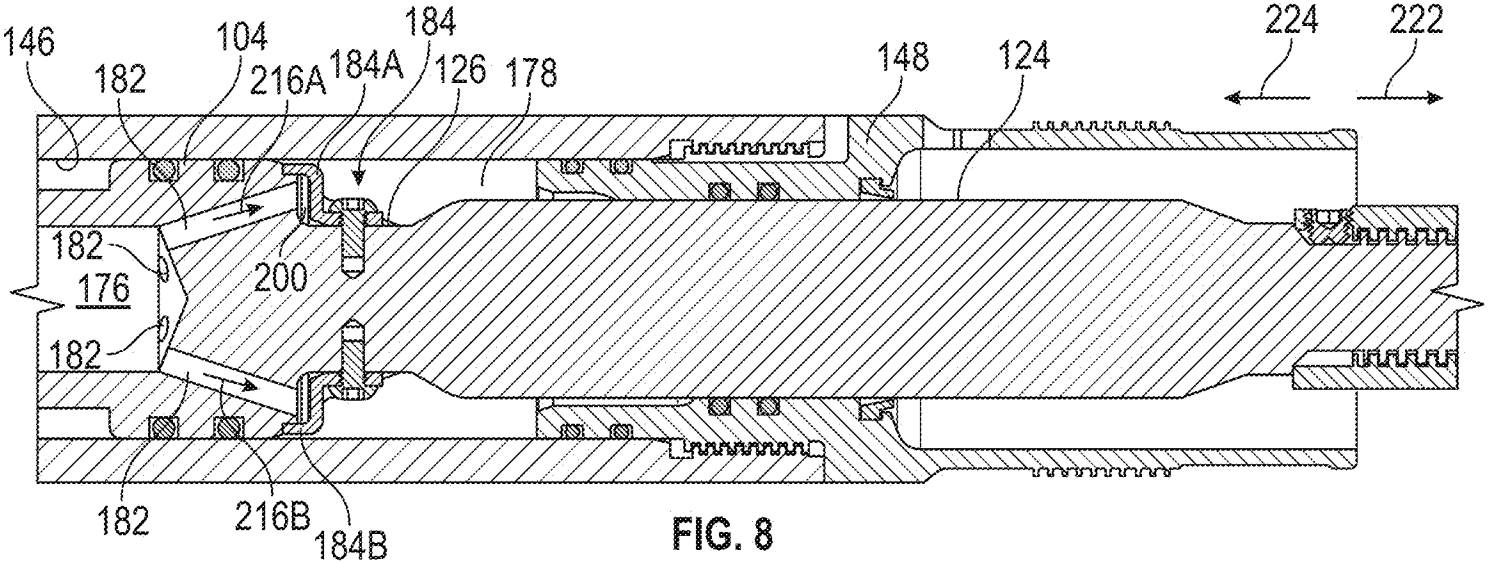
FIGS. 8 and 9 are partial cross-sectional views of the setting tool of FIG. 3 partially stroked.
Figure 9:
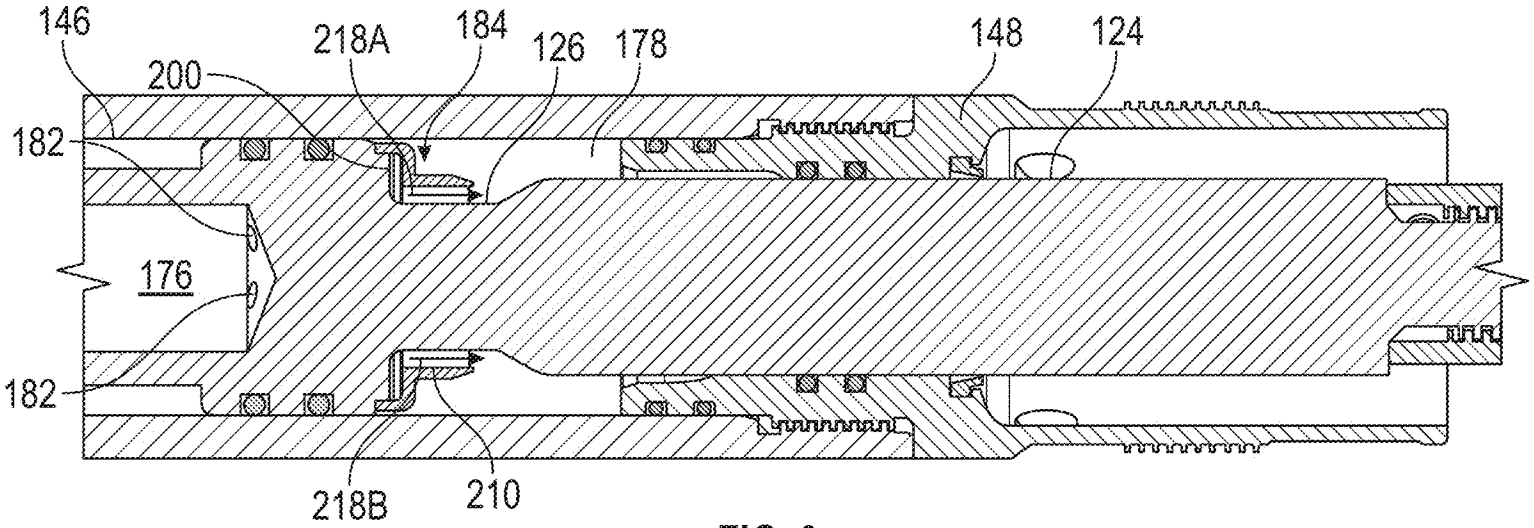

Generally, exhaust diffuser 184 redirects the flow of combustion products from an angular or inclined direction to an axial direction. Turning now to FIGS. 8 and 9, the passage of combustion products from the firing chamber 176 to the expansion chamber 178 is illustrated by inclined flowpaths 216 extending through exhaust ports 182, and axial flowpaths 218 extending through exhaust passage 210. passage The setting tool 100 is illustrated about mid-stroke in FIGS. 8 and 9 with housing adapter 148 having traveled axially about midway along the outer surface 124 of the piston 104. In this configuration, the pressure within expansion chamber 178 acts on the cross-sectional area of the housing adapter 148 to move the housing 102 and housing adapter 148 in a first or downhole axial direction 222 relative to the piston 104. The expansion chamber 178 increases in volume as the housing adapter 148 moves axially in the downhole axial direction 222 relative to the piston 104. The balance chamber 174 (shown in FIG. 3) correspondingly decreases in volume as the expansion chamber 178 increases in volume.

In FIG. 8, combustion products from the burning of the combustible element 180 within the firing chamber 176 pass along inclined flowpaths 216 and through the plurality of exhaust ports 182 to impinge on the baffle face 200 of the exhaust diffuser 184. In FIG. 9, the combustion products pass along axial flowpaths 218 and through the plurality of exhaust passages 210 exits to the expansion chamber 178. The baffle face 200, oriented generally orthogonal to the exhaust ports 182, force the combustion products exiting exhaust ports 182 to make a substantial change of direction, thereby reducing the velocity of the combustion products before the combustion products are permitted to contact the surrounding housing 102.

Additionally, mineral deposits which would otherwise form or collect on surfaces of the housing 102 and piston 104 instead form and collect on surfaces of exhaust diffuser 184, including the baffle face 200. In some embodiments, exhaust diffuser 184 may comprise a sacrificial element which may be periodically replaced (suffering from erosion and corrosion due to exposure from the combustion products) while the more expensive and difficult to manufacture housing 102 and piston 104 are repeatedly reused. In some embodiments, exhaust diffuser 184 may comprise a material which varies from the material from which the housing 102 and/or piston 104 are comprised. For example, housing 102 and/or piston 104 may comprise erosion and/or corrosion resistant materials intended to maximize the operational service life of the housing 102 and/or piston 104. Conversely, exhaust diffuser 184 may be formed from an inexpensive material not intended to survive exposure to the combustion products for more than a limited number of uses. In this manner the cost of operating setting tool 100 may be minimized by maximizing the operational service life of the housing 102 and piston 104 in exchange for focusing the erosion and corrosion generated by the combustion products onto the sacrificial exhaust diffuser 184 which may be quickly and inexpensively replaced between different uses of the setting tool 100.

In this manner, the exhaust diffuser 184 redirects the flow of combustion products from the inclined direction along inclined flowpaths 216 to an axial direction along axial flowpaths 218 within the exhaust diffuser 184 defined by the surfaces of the first recess 126, the passage surface 212, the first side 214, and the second side 216. In this manner, each exhaust passage 210 intersects the baffle face 200 of the exhaust diffuser 184 (shown best in FIG. 7) to provide a pathway for the flow of combustion products to transition from the inclined flowpath 216 extending through the exhaust ports 182 to the axial flowpath 218 extending through exhaust passages 210.

Figure 10:
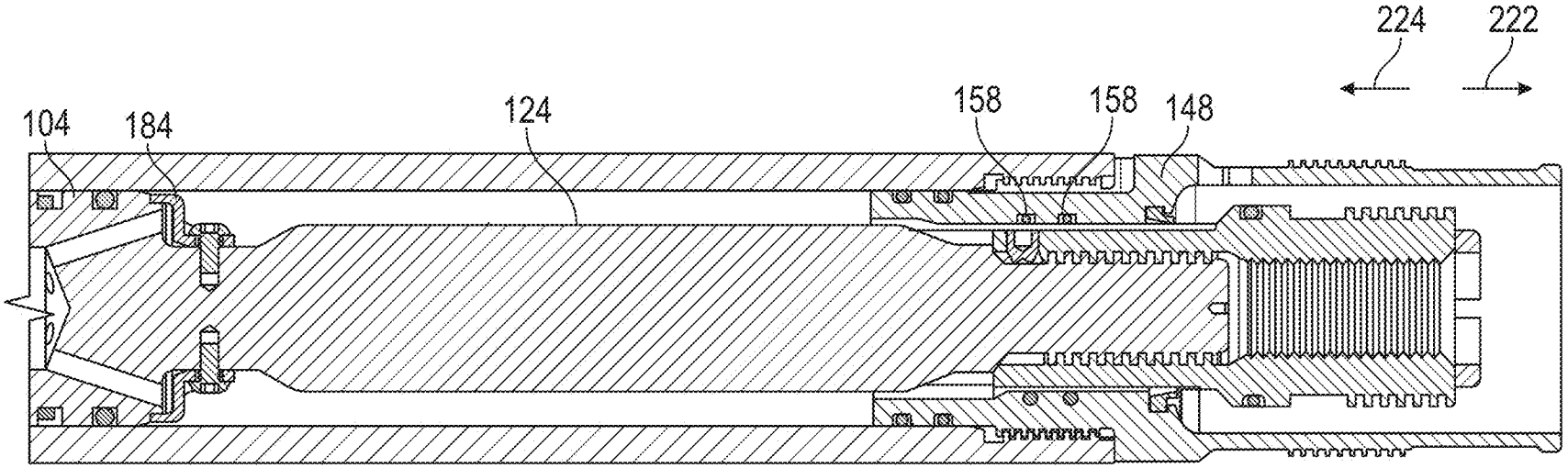
FIG. 10 is a partial cross-sectional view of the setting tool of FIG. 3 maximally stroked.

Turning now to FIG. 10, the expansion chamber 178 of setting tool 100 continues to increase in volume as the housing adapter 148 continues to travel in the downhole axial direction 222 until the setting tool 100 reaches maximum stroke as shown particularly in FIG. 10. The setting tool 100 continues to stroke, e.g., the volume of the expansion chamber 178 continues to increase, until the seal assembly 158 on the housing adapter 148 moves past and out of scaling engagement with the outer surface 124 of the piston 104.

Figure 11:
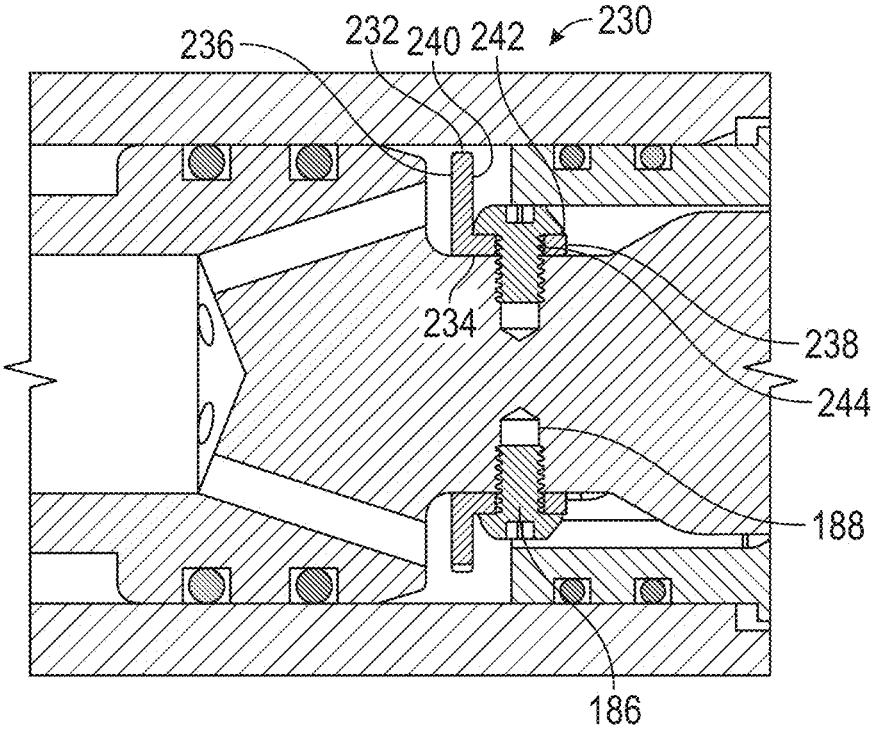
FIG. 11 is a partial cross-sectional view of another embodiment of a setting tool.

Turning now to FIG. 11, another embodiment of an exhaust diffuser 230 is shown. Exhaust diffuser 230 includes features in common with the exhaust diffuser 182 shown in FIGS. 4-7, and shared features are labeled similarly. In this exemplary embodiment, exhaust diffuser 230 has a cylindrical shape with a radially outer surface 232, a radially inner surface 234, a baffle surface 236, and a downhole surface 238. Exhaust diffuser 230 has a generally L-shape with a front surface 240 and a top surface 242. One or more fasteners can attach the exhaust diffuser 230 to a fastener port 188 on the piston 104.

Figure 12:
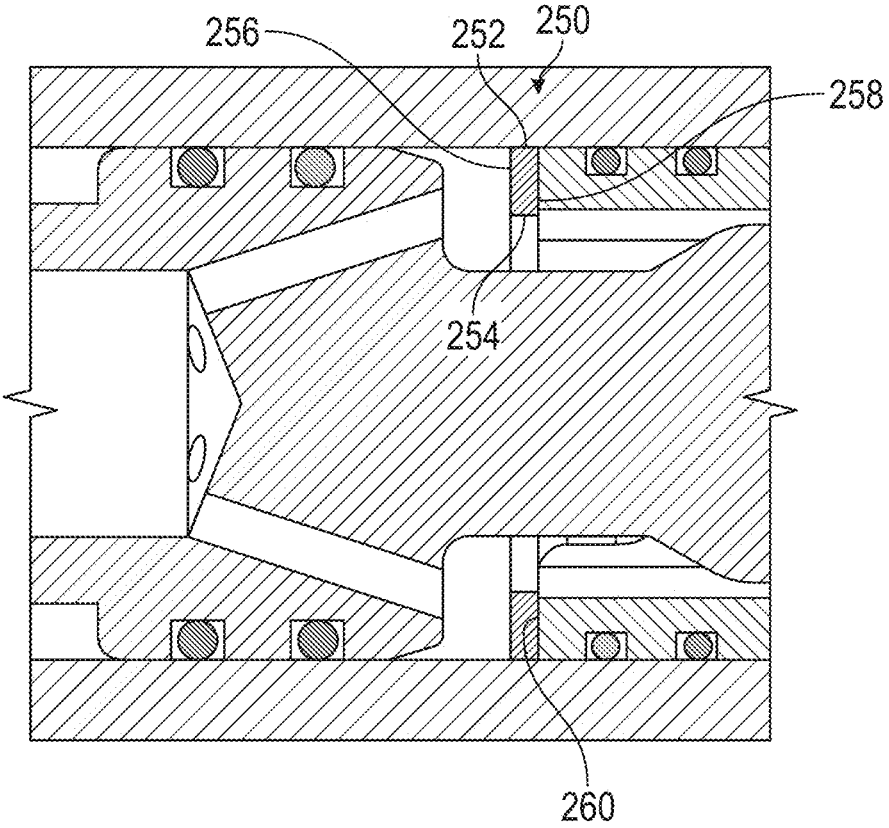
FIG. 12 is a partial cross-sectional view of another embodiment of a setting tool.

Turning now to FIG. 12, another embodiment of an exhaust diffuser 250 is shown. Exhaust diffuser 250 includes features in common with the exhaust diffuser 182 shown in FIGS. 4-7, and shared features are labeled similarly. In this exemplary embodiment, exhaust diffuser 250 has a ring shape with a radially outer surface 252, a radially inner surface 254, an uphole surface 256, and a downhole surface 258. The downhole surface 258 of exhaust diffuser 250 abuts the uphole surface 260 of the housing adapter 148.

Figure 13:
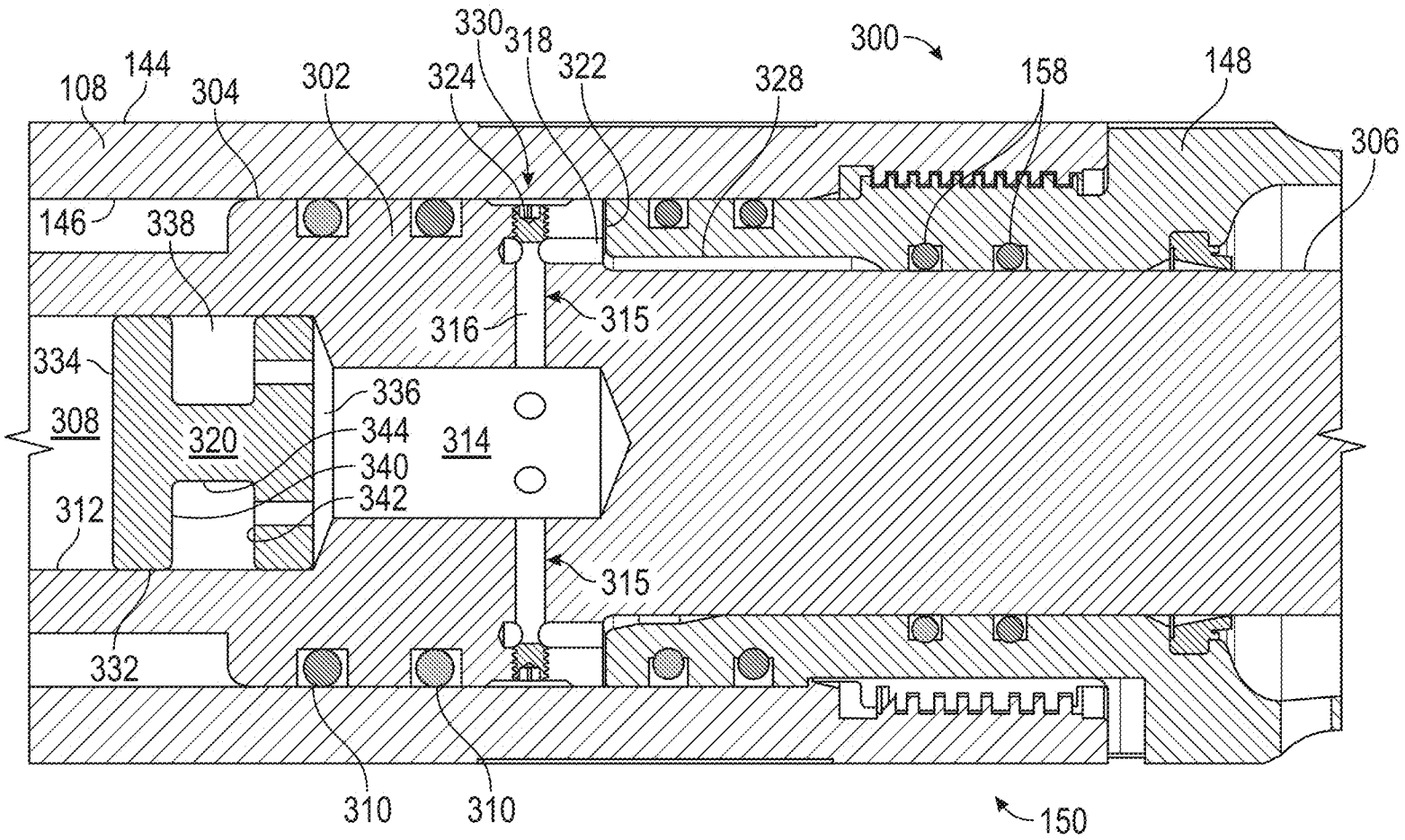
FIG. 13 is a cross-sectional view of another embodiment of a setting tool.
Figure 14:
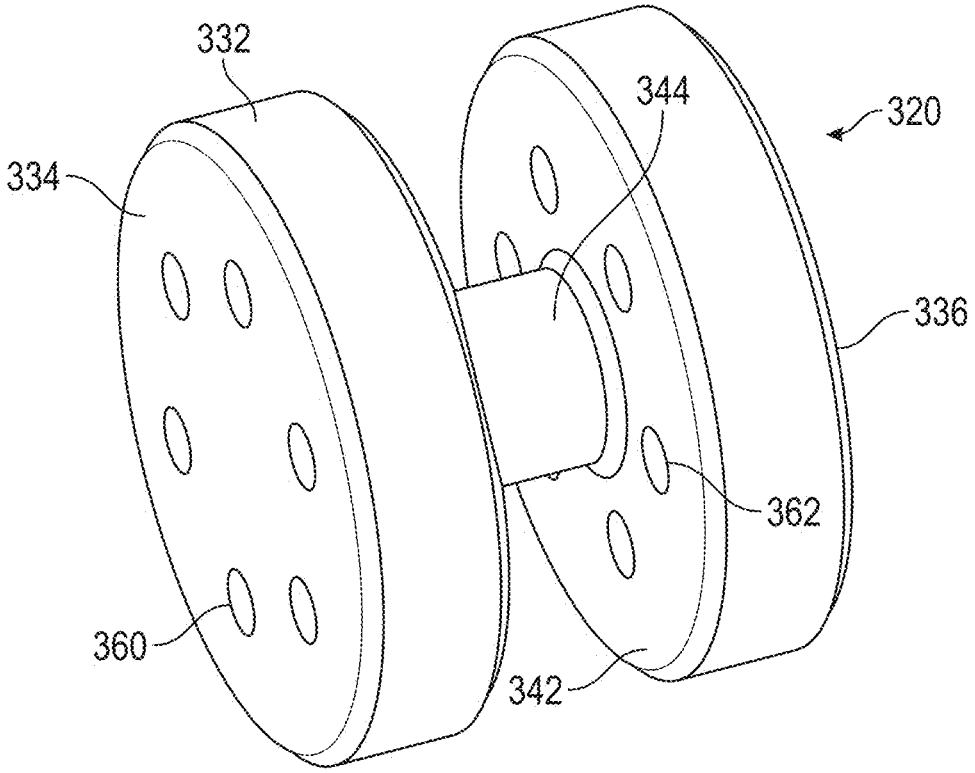
FIG. 14 is a perspective view of a flow plug side another embodiment of a setting tool.

In some embodiments, the piston of the setting tool may be configured with a plurality of axial ports to direct the exhaust parallel to the inner surface of the housing. Turning now to FIGS. 13 and 14, another embodiment of a setting tool 300 is shown. Setting tool 300 includes features in common with the setting tool 100 shown in FIGS. 3-7, and shared features are labeled similarly. In this exemplary embodiment, setting tool 300 generally includes a piston 302, housing 108, housing adapter 148, and an exhaust diffuser 320. Piston 302 of setting tool 300 has an annular seal assembly 310 comprising a pair of annular seals disposed on an outer surface 304. Piston 302 additionally includes a radially outer surface 306 located downhole of the annular seal assembly 310. Additionally, piston 302 includes a central bore ore passage 308 defined by an inner surface 312, and a secondary bore or passage 314 extending centrally into piston 302 from central bore 308.

In this exemplary embodiment, piston 302 includes one or more circumferentially spaced exhaust ports 315 each comprising a radial port 316 and an axial port 318. The radial port 316 of a given exhaust port 315 extends from the outer surface 304 of piston 302 to the secondary bore 314 of piston 302. The axial port 318 of a given exhaust port 315 extends from the end face 322 to intersect with the radial ports 316 of the piston 302. A plug 324 may be sealingly engaged with the radial ports 316; however, it may be understood that the configuration of exhaust ports 315 may vary in other embodiments. In this configuration, exhaust ports 315 direct a radial flow of combustion products from the secondary bore 314 to transition to an axial flow of fluid within the axial port 318.

As previously described, the housing 108 has a cylinder shape and is slidably disposed on the piston 104 with an outer surface 144 and an inner surface 146. Housing 108 includes a housing adapter 148 releasably coupled with the housing 108. In this exemplary embodiment, housing adapter 148 includes a seal assembly 158 in sealing engagement with outer surface 306 of the piston 302. Additionally, piston 302 includes an annular seal assembly 310 in sealing engagement with the inner surface 146 of the housing 108 and the seal assembly 158 in sealing engagement with the outer surface 306 of the piston 302 form an annular expansion chamber 328 that is fluidically connected to the central bore 308 via the plurality of exhaust ports 330.

In this exemplary embodiment, exhaust diffuser 320 comprises a flow plug that slidingly engages the central bore 308 of piston 302 and thus may also be referred to herein as flow plug 320. In this exemplary embodiment, Flow plug 320 is generally cylindrical in shape and includes an outer surface 332, an uphole face 334, a downhole face 336, and an annular groove 338 located between the uphole face 334 and downhole face 336. Particularly, flow plug 320 has one or more grooves 338 formed in the outer surface 332 with a front surface 340, a back surface 342, and a bottom surface 344. The grooves 338 have a rectangular cross-section in this exemplary embodiment with the front surface 340 parallel to the back surface 342. It may be understood that the geometry of grooves 338 may vary in other embodiments. For example, the groove 338 can be other shapes in the cross-section; e.g., V-shaped, U-shaped, or with curved front surface 340 and curved back surface 342.

As shown particularly in FIG. 14, flow plug 320 includes one or more circumferentially spaced first or upstream flow ports 360 extending from the uphole face 334 to the front surface 340 of the groove 338. Additionally, flow plug 320 includes one or more circumferentially spaced second or downstream flow ports 362 extending from the downhole face 336 to the back surface 342 of the groove 338. Downstream flow ports 362 are axially spaced and downstream of the combustion products relative to the upstream flow ports 360 of flow plug 320. Additionally, each of the upstream flow ports 360 in are rotated out of plane or circumferentially spaced from each of the downstream flow ports 362. For example, a first upstream flow port 360 can be located at 90° while a first downstream flow port 362 can be located at 105° and so on and so forth such that none of the upstream flow ports 360 circumferentially align with any of the downstream flow ports 362. In some embodiments, each downstream flow port 362 is circumferentially spaced by a predefined angular offset from at least one of the upstream flow ports 360. The angular offset may range approximately between 5° and 30° in some embodiments; however, it may be understood that the angular offset and spacing of flow ports 360 and 362 may vary.

In operation, combustion products flow from the central bore 308 to the expansion chamber 328 as the setting tool 300 strokes to actuate the auxiliary tool 44. The combustion products flow through the flow ports 360, into the groove 338, and through the flow ports 362. A portion of the flow of combustion products passes between the outer surface 332 of the flow plug 320 and the inner surface 312 of the central bore 308 of piston 302. The restriction to fluid flow through the flow plug 320 may be adjusted depending on the number and geometry of the flow ports 360 and the flow ports 362. The flow of combustion products pass through the secondary bore 314 to enter the exhaust ports 330. The flow of combustion products transitions from radial flow direction within the radial ports 316 to an axial flow direction within the axial ports 318. The flow of combustion products may be restricted through the plurality of exhaust ports 330 depending on the number and geometry of the exhaust ports 330. The flow exiting the exhaust ports 330 is parallel to the inner surface 146 of the housing 108.

Figure 15:
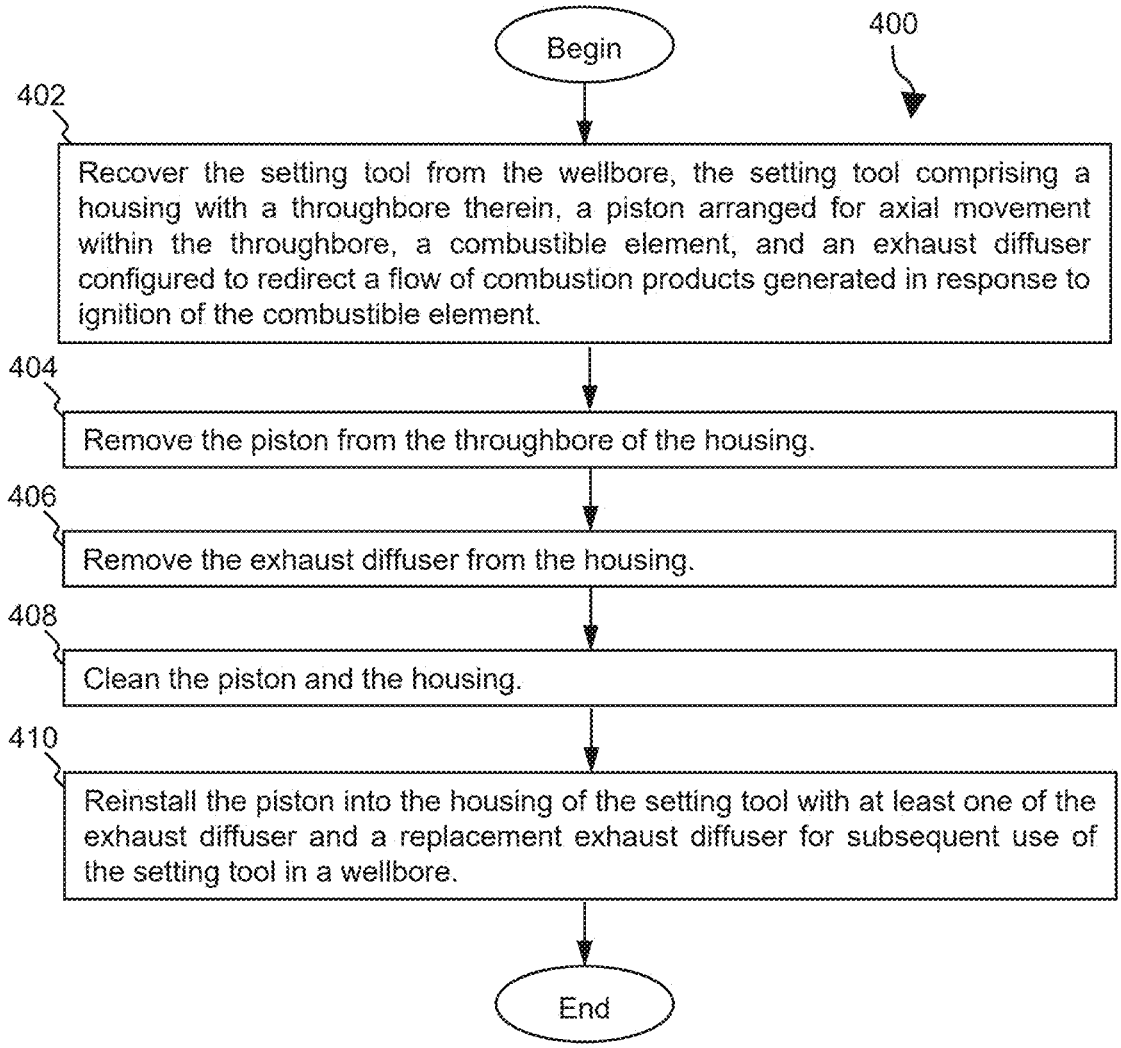
FIG. 15 is a block diagram of an embodiment of a method for redressing a setting tool for actuating a plug in a subterranean wellbore.

Referring now to FIG. 15, an embodiment of a method 400 for redressing a setting tool for actuating a plug in a subterranean wellbore is shown. Beginning at block 402, method 400 comprises recovering the setting tool from the wellbore, the setting tool comprising a housing with a throughbore therein, a piston arranged for axial movement within the throughbore, a combustible element, and an exhaust diffuser configured to redirect a flow of combustion products generated in response to ignition of the combustible element. In some embodiments, block 402 comprises recovering one of the setting tools 100 and 300 described above from the wellbore 14.

At block 404, method 400 comprises removing the piston from the throughbore of the housing. In some embodiments, block 404 comprises removing the piston 104 from the throughbore of the housing 108 of setting tool 100. At block 406, method 400 comprises removing the exhaust diffuser from the housing. In some embodiments, block 406 comprises removing one of the exhaust diffusers 184, 230, 250, and 32 described herein from the housing 108. At block 408, method 400 comprises cleaning the piston and the housing. In some embodiments, block 408 comprises removing foreign materials or debris that have accumulated onto the piston and the housing of the setting tool (e.g., onto the piston 104 and the housing 108 of setting tool 100). The removal of debris from the piston and housing may include buffing, scraping, heating, washing, treating via one or more chemicals, and other techniques for cleaning the piston and the housing. Additionally, consumable parts such as elastomeric seals, fasteners, etc., of the piston and the housing may be replaced to redress the setting tool.

At block 410, method 400 comprises reinstalling the piston into the housing of the setting tool with at least one of the exhaust diffuser and a replacement exhaust diffuser for subsequent use of the setting tool in a wellbore. In some embodiments, block 410 comprises reinstalling the piston 104 into the housing 108 of setting tool 100 with at least one of the exhaust diffusers 184, 230, 250, and 32 described herein, where the exhaust diffuser may be the previously used exhaust diffuser or a new, unused exhaust diffuser. For example, in some embodiments, the previously used exhaust diffuser may be cleaned prior to being reinstalled in the housing. In this manner, foreign materials or debris may be removed from the exhaust diffuser in a manner similar to the cleaning of the piston and the housing briefly addressed above.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method for redressing a setting tool for actuating a plug in a subterranean wellbore, the method comprising:

(a) recovering the setting tool from the wellbore, the setting tool comprising a housing with a throughbore therein, a piston arranged for axial movement within the throughbore, a combustible element, and an exhaust diffuser configured to redirect a flow of combustion products generated in response to ignition of the combustible element, wherein the setting tool comprises an initial configuration prior to the generation of the flow of combustion products and in which the piston is located in a first axial position in the housing, and a set configuration with the piston located in a second axial position in the housing spaced from the first axial position, the piston being displaced from the first axial position to the second axial position by the flow of combustion products, and wherein fluid communication is permitted through the exhaust diffuser in both the initial configuration and the set configuration;

(b) removing the piston from the throughbore of the housing;

(c) removing the exhaust diffuser from the housing;

(d) cleaning the piston and the housing; and (e) reinstalling the piston into the housing of the setting tool with at least one of the exhaust diffuser and a replacement exhaust diffuser for subsequent use of the setting tool in a wellbore.

2. The method according to claim 1, wherein (e) comprises orienting at least a portion of a baffle face of at least one of the exhaust diffuser and the replacement exhaust diffuser at an angle that is between 60° and 120° relative to a longitudinal axis of an exhaust port of the piston.

3. The method according to claim 1, wherein (e) comprises positioning at least one of the exhaust diffuser and the replacement exhaust diffuser in an annular expansion chamber formed radially between an outer surface of the piston and an inner surface of the housing.

4. The method according to claim 1, wherein (e) comprises positioning at least one of the exhaust diffuser and the replacement exhaust diffuser in an internal firing chamber formed within the piston.

5. The method according to claim 1, wherein (e) comprises releasably coupling at least one of the exhaust diffuser and the replacement exhaust diffuser to the piston.

6. The method according to claim 1, wherein (e) comprises releasably coupling at least one of the exhaust diffuser and the replacement exhaust diffuser to the housing.

7. The method according to claim 1, wherein:

(d) comprises cleaning the exhaust diffuser; and (e) comprises reinstalling the piston into the housing of the setting tool with the cleaned exhaust diffuser.

8. The method according to claim 1, wherein (e) comprises reinstalling the piston into the housing of the setting tool with the replacement exhaust diffuser.

9. A method for redressing a setting tool for actuating a plug in a subterranean wellbore, the method comprising:

(a) recovering the setting tool from the wellbore, the setting tool comprising a housing with a throughbore therein, a piston arranged for axial movement within the throughbore, a combustible element, and an exhaust diffuser, wherein the setting tool comprises an initial configuration prior to generation of a flow of combustion products and in which the piston is located in a first axial position in the housing, and a set configuration with the piston located in a second axial position in the housing spaced from the first axial position, the piston being displaced from the first axial position to the second axial position by the flow combustion products generated in response to ignition of the combustible element, the flow of combustion products being obstructed by the exhaust diffuser, and wherein fluid communication is permitted through the exhaust diffuser in both the initial configuration and the set configuration with the exhaust diffuser configured to obstruct flow along a flowpath extending from an exhaust port of the piston in both the initial configuration and the set configuration;

(b) removing the piston from the throughbore of the housing;

(c) removing the exhaust diffuser from the housing;

(d) cleaning the piston and the housing; and (e) reinstalling the piston into the housing of the setting tool with at least one of the exhaust diffuser and a replacement exhaust diffuser for subsequent use of the setting tool in a wellbore.

10. The method according to claim 9, wherein (e) comprises orienting at least a portion of a baffle face of at least one of the exhaust diffuser and the replacement exhaust diffuser at an angle that is between 60° and 120° relative to a longitudinal axis of the exhaust port of the piston.

11. The method according to claim 9, wherein (e) comprises positioning at least one of the exhaust diffuser and the replacement exhaust diffuser in an internal firing chamber formed within the piston.

12. The method according to claim 9, wherein (e) comprises releasably coupling at least one of the exhaust diffuser and the replacement exhaust diffuser to the piston.

13. The method according to claim 9, wherein (e) comprises releasably coupling at least one of the exhaust diffuser and the replacement exhaust diffuser to the housing.

14. The method according to claim 9, wherein (e) comprises reinstalling the piston into the housing of the setting tool with the replacement exhaust diffuser.

15. A method for redressing a setting tool for actuating a plug in a subterranean wellbore, the method comprising:

(a) recovering the setting tool from the wellbore, the setting tool comprising a housing with a throughbore therein, a piston arranged for axial movement within the throughbore, a combustible element, and an exhaust diffuser comprising an annular, radially extending baffle face configured to redirect a flow of combustion products generated in response to ignition of the combustible element, wherein the setting tool comprises an initial configuration prior to generation of a flow of combustion products and in which the piston is located in a first axial position in the housing, and a set configuration with the piston located in a second axial position in the housing spaced from the first axial position, the piston being displaced from the first axial position to the second axial position by the flow of combustion products, and wherein fluid communication is permitted through the exhaust diffuser in both the initial configuration and the set configuration;

(b) removing the piston from the throughbore of the housing;

(c) removing the exhaust diffuser from the housing;

(d) cleaning the piston and the housing; and (e) reinstalling the piston into the housing of the setting tool with at least one of the exhaust diffuser and a replacement exhaust diffuser for subsequent use of the setting tool in a wellbore.

16. The method according to claim 15, wherein (e) comprises orienting at least a portion of a baffle face of at least one of the exhaust diffuser and the replacement exhaust diffuser at an angle that is between 60° and 120° relative to a longitudinal axis of an exhaust port of the piston.

17. The method according to claim 15, wherein (e) comprises positioning at least one of the exhaust diffuser and the replacement exhaust diffuser in an internal firing chamber formed within the piston.

18. The method according to claim 15, wherein (e) comprises releasably coupling at least one of the exhaust diffuser and the replacement exhaust diffuser to the piston.

19. The method according to claim 15, wherein (e) comprises releasably coupling at least one of the exhaust diffuser and the replacement exhaust diffuser to the housing.

20. The method according to claim 15, wherein (e) comprises reinstalling the piston into the housing of the setting tool with the replacement exhaust diffuser.

* * * * *